US008171919B2

(12) United States Patent
Klipfel et al.

(10) Patent No.: US 8,171,919 B2
(45) Date of Patent: May 8, 2012

(54) EXHAUST GAS RECIRCULATION VALVE

(75) Inventors: Bernhard Klipfel, Karlsruhe (DE); Christoph Thiery, Mannheim (DE)

(73) Assignee: Cooper-Standard Automotive (Deutschland) GmbH, Schelklingen (DE)

( * ) Notice: Subject to any disclaimer, the term of this patent is extended or adjusted under 35 U.S.C. 154(b) by 297 days.

(21) Appl. No.: 12/574,575

(22) Filed: Oct. 6, 2009

(65) Prior Publication Data

US 2010/0176325 A1 Jul. 15, 2010

(30) Foreign Application Priority Data

Oct. 6, 2008 (EP) ..... 08165906

(51) Int. Cl.
*F02M 25/07* (2006.01)
*F02M 25/06* (2006.01)

(52) U.S. Cl. ..... 123/568.23; 123/188.1

(58) Field of Classification Search ..... 123/568.23, 123/568.24, 568.11, 188.1, 188.2, 188.17, 123/190.1; 251/129.11
See application file for complete search history.

(56) References Cited

U.S. PATENT DOCUMENTS 6,039,034 A * 3/2000 Field et al. ..... 123/568.23
6,135,415 A * 10/2000 Kloda et al. ..... 251/129.11
6,886,546 B1 * 5/2005 Bircann et al. ..... 123/568.23
2005/0092308 A1 * 5/2005 Tsokonas ..... 123/568.23
2006/0156846 A1 * 7/2006 Neubauer et al. ..... 74/425

FOREIGN PATENT DOCUMENTS

| | | |
|---|---|---|
| EP | 0 887 540 | 12/1998 |
| EP | 0 856 657 | 1/2003 |
| EP | 1 526 271 | 6/2007 |
| EP | 1 882 843 | 1/2008 |
| WO | WO 2005/021954 | 3/2005 |

OTHER PUBLICATIONS

European Search Report, Application No. 08 16 5906.2; Mar. 13, 2009.

* cited by examiner

*Primary Examiner* — Mahmoud Gimie
(74) *Attorney, Agent, or Firm* — Knobbe Martens Olson & Bear LLP

(57) ABSTRACT

An exhaust gas recirculation valve comprises a drive, at least one rotatable drive element and at least one translationally drivable driven element. The drive element comprises a thread element that is configured to convert rotational motion of the drive element into translation of the driven element. A rotational axis of the drive element is inclined with respect to a translational axis of the driven element.

22 Claims, 2 Drawing Sheets

EXHAUST GAS RECIRCULATION VALVE

CROSS-REFERENCE TO RELATED APPLICATIONS

This application is related to, and claims priority from, European Patent Application No. 08 165 906.2, filed Oct. 6, 2008, entitled "EXHAUST GAS RECIRCULATION VALVE," the entirety of which is incorporated by reference herein and made a part of the present specification.

BACKGROUND OF THE INVENTION

1. Field of the Invention

The invention concerns an exhaust gas recirculation valve. In the field of combustion engines, it is known to recirculate exhaust gas toward the fresh air side depending on operating conditions in order to reduce fuel consumption and noxious emissions.

2. Description of the Related Art

From EP 1 111 227 A2 an exhaust gas recirculation valve is known in which the rotary motion of a drive motor is converted into a translational motion of the valve element. At least at the beginning of the opening operation the valve element is given a rotary motion.

EP 1 526 271 A1 concerns an exhaust gas recirculation valve in which the rotary motion of a drive motor is converted into a stroke movement of the valve element, wherein the valve element may rotate with the drive element upon opening, but is not urged to rotate along with it. The conversion of the rotary motion into a stroke movement is effected substantially by means of a driven threaded "worm" which engages a stationary but rotatable wheel.

SUMMARY OF THE INVENTION

It is an object of the invention to provide an exhaust gas recirculation valve which is improved in particular with regard to reliability during operation.

This object is achieved by means of an exhaust gas recirculation valve as defined in claim 1 or claim 10.

Accordingly, it comprises a drive, at least one rotatable drive element and at least one translationally driven output-side element (driven element). Here, a rotational axis of the drive element is inclined with respect to a translational axis of the driven element. The drive of the exhaust gas recirculation valve is preferably configured as rotary drive, but not limited thereto. The rotatable drive element is a threaded element, for example a worm gear having a thread or a part of a thread. The worm gear might simply be referred to as a "worm" in the English language and is also referred to as a "worm" herein. The translationally driven element is engaged with the worm in such manner that a rotation of the worm leads to a translational motion of the driven element. For example, the driven element may be a portion protruding from the valve tappet (lifter), a wheel or pulley protruding thereon and engaging the worm, or an element having a counter-thread.

According to the invention, the rotational axis of the drive element is inclined with respect to the translational axis of the driven element. In a geometrical sense, both axes are skew to each other. Substantially, this results in the force transmission between the drive and driven element occurring in a direction which is not inclined with respect to the contact face of the drive element or at least not that much inclined as hitherto. Conventionally, if the rotational axis of the drive element and the translational axis of the driven element are parallel to each other, the force transmission from the worm to the driven element occurs via a surface which is inclined with respect to the translational axis of the driven element. This has the result that a rectilinear force applied by the driven element, for instance due to the gas pressure, may result in a torsion (twisting) of the drive element, which may lead to an unintended displacement of the valve element. In the exhaust gas recirculation valve according to the invention such an inclination between the translational axis of the driven element and the rotational axis of the drive element is reduced so that higher forces are necessary for twisting the drive element. Thus, in practice it can largely be precluded that the valve is inadvertently displaced due to gas forces.

Preferred embodiments are described in the dependent claims. In particular, it is preferred that the drive element comprises a surface with which at least a portion, for instance the mentioned protrusion or the described small wheel, of the driven element is in contact and which surface is largely perpendicular to the translational axis of the driven element. By this arrangement any force applied by the driven element acts in a direction largely perpendicular to the surface on the drive element and, thus, cannot cause an unintentional twisting of the same.

Further, it is presently preferred that a location at which a portion of the driven element is in contact with the drive element is at least largely aligned with an axis of the translationally-moved valve element. Thus, no transverse or lateral forces are applied onto the arrangement consisting of the translationally-moved valve element and the driven element operatively connected therewith. This offers advantages for the steady (permanent) operation of the valve. The described orientation of a contact location on the drive element with respect to the translational axis of the valve element may, however, be advantageously combined with the above-described feature as well as with all of the features described in the following.

For the exhaust gas recirculation valve according to the invention, it has proven to be advantageous if the valve element is only translationally movable but not twistable. Thus, delays and obstructions of the opening motion may advantageously be reduced in the response behavior.

Further, with regard to the opening direction of the valve element, it is currently preferred that it is oriented (runs) against the exhaust gas pressure. Thus, the exhaust gas counterpressure may advantageously be used for assisting the closure of the valve and, thus, for minimizing the amount of leakage in the closed state.

Preferably, a single-stage gear is provided between the drive and the drive element. Due to such a single-stage transmission the response behavior of the valve is improved, in particular due to reduced friction and lower mass inertia. Alternatively, the gear may also be a two- or multi-stage gear, which allows the generation of higher forces.

Preferably, the drive element is further connected at least indirectly with a spring element, for instance a coil spring, which is solely twisted. Such a spring element advantageously ensures, in terms of a failsafe operation also during a fault or interruption in the electrical system, that the valve closes.

Further, for a valve housing in which the valve element is arranged, it has proven advantageous to construct this valve housing in one piece, for instance as cast housing. Thus, the number of utilized parts may be advantageously reduced.

Lastly, it is currently preferred to provide the valve housing with at least one cooling channel. Thus, the valve housing may be cooled in particular in proximity to the valve tappet so that the durability of the valve tappet and the plunger seal and plunger guide, and thus of the exhaust gas recirculation valve as a whole, may be improved.

BRIEF DESCRIPTION OF THE DRAWINGS

In the following, the invention is described in further detail by means of an embodiment illustrated by way of example in the figures.

DETAILED DESCRIPTION OF THE PREFERRED EMBODIMENT

Figure 1:
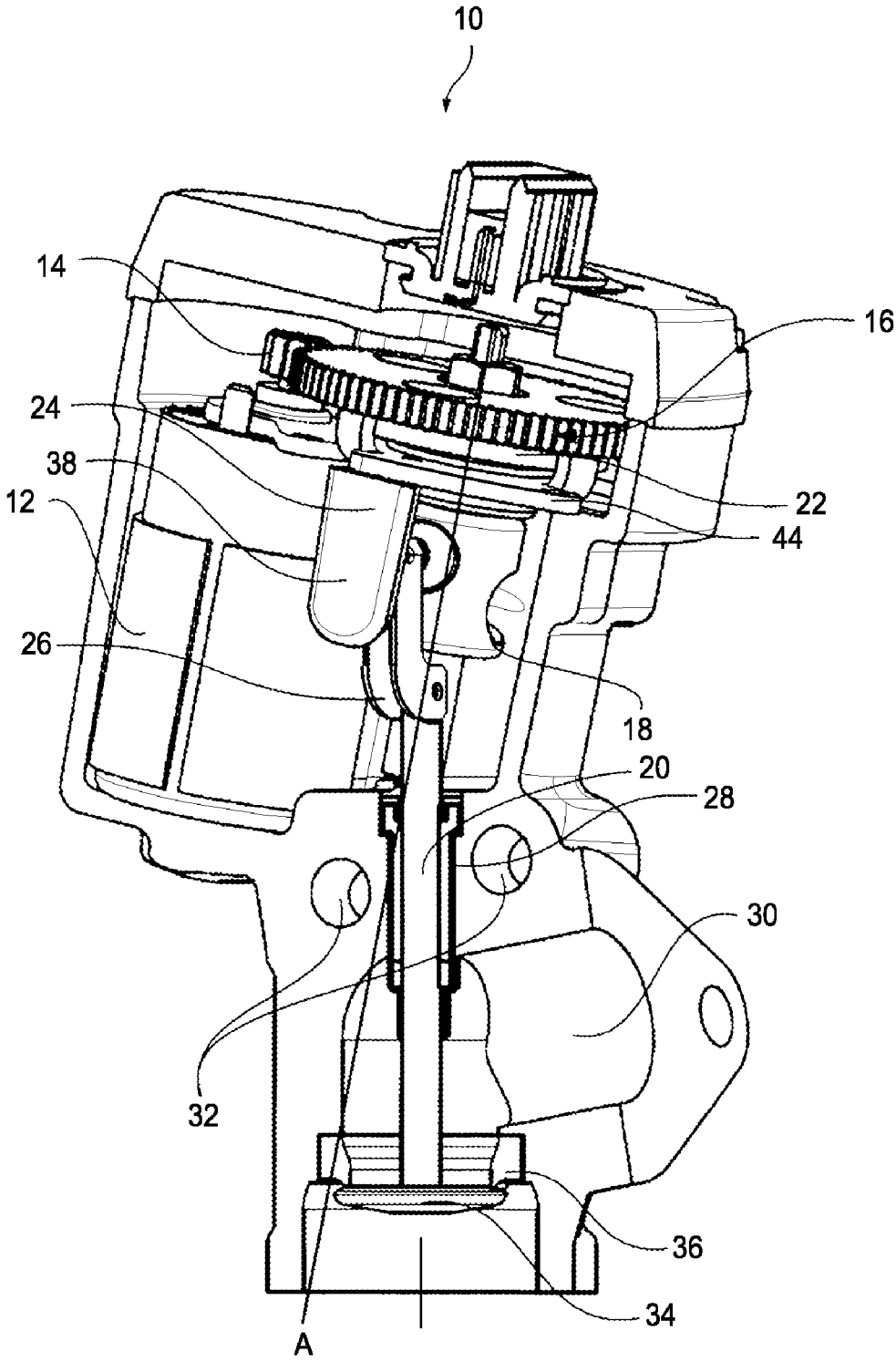
FIG. 1 shows a side view of the exhaust gas recirculation valve according to the invention.

As can be seen from FIG. 1, the exhaust gas recirculation valve 10 according to the invention comprises a drive 12 in the form of an inclined motor. In the illustrated embodiment, a pinion 14 is arranged on the motor shaft and drives a gear 16. The drive element 18 in the form of a worm gear (or worm) is attached to the gear 16 and drives the valve tappet 20 as described in more detail below. In the illustrated embodiment, as can be seen in more detail from FIG. 2, the worm comprises an axis A that is supported both at its upper end and at its lower end. In the illustrated embodiment, the arrangement of gear 16 and worm 18 is connected to a coil spring 22 which is solely twisted upon opening and closing of the valve. In the illustrated embodiment, the combination of pinion 14 and gear 16 corresponds to a single-stage transmission having the above-described advantages.

The conversion of the rotary motion of the worm 18 into a translational motion of the valve tappet 20 is effected by means of the driven element 24 which, in the illustrated embodiment, is configured as a small wheel and is in engagement with the thread of the worm 18. The small wheel 24 is rotatably attached to a bracket 26 fixed to the valve tappet 20. The valve tappet 20 is supported in a suitable bushing 28 which, in the illustrated embodiment, is provided in a valve housing 30 configured as a one-piece cast part. Moreover, as can be seen from FIG. 2, the valve housing 30 may be configured so as to additionally receive the drive 12 and the arrangement of drive element 18 and driven element 24. Only the transmission in the form of the pinion 14, the gear 16 and the coil spring 22 are located in the area of a lid 40. This lid may further comprise a connector (socket) 42 for electric terminals. For example, a connection to a controller connected to an engine control unit may be performed by means of this socket in order to electronically control the operation of the valve. With the coolant parts 32 one may discern that the valve housing 30 may advantageously be cooled in order to cool the valve tappet 20 and its bearing and seal, too.

A valve head (plate) 34 engaging a valve seat 36, which advantageously is provided with rather sharp edges is attached to the valve tappet 20. Advantageously, the valve element in the form of the valve head 34 is always, that is both in the open and the closed state, situated within the valve housing 30. In the illustrated embodiment, the opening of the valve head 36 is effected against the exhaust gas pressure, that is, it opens downward according to the orientation of FIG. 1, so that the valve head 36 assists in closing the valve in response to exhaust gas pressure. At the same time, there is no danger that the exhaust gas pressure inadvertently displaces the valve, due to the following reasons.

As can be seen from FIG. 1, the rotational axis A of the worm 18 serving as drive element is inclined with respect to the translational axis of the driven element 24, in other words, with respect to the axis of the valve tappet 20. Thus, in the illustrated embodiment, the surface in the region of the thread of the worm 18 engaging the small wheel 24 may be disposed largely perpendicular to the axis of the valve tappet 20. Thus, if a force acts upon the valve tappet 20, for example due to the exhaust gas pressure, this force will largely act perpendicular to the surface in the area of the thread of the worm 18, and consequently cannot twist it. Thus, an inadvertent displacement of the valve may advantageously be avoided, a circumstance particularly relevant for small openings.

Figure 2:
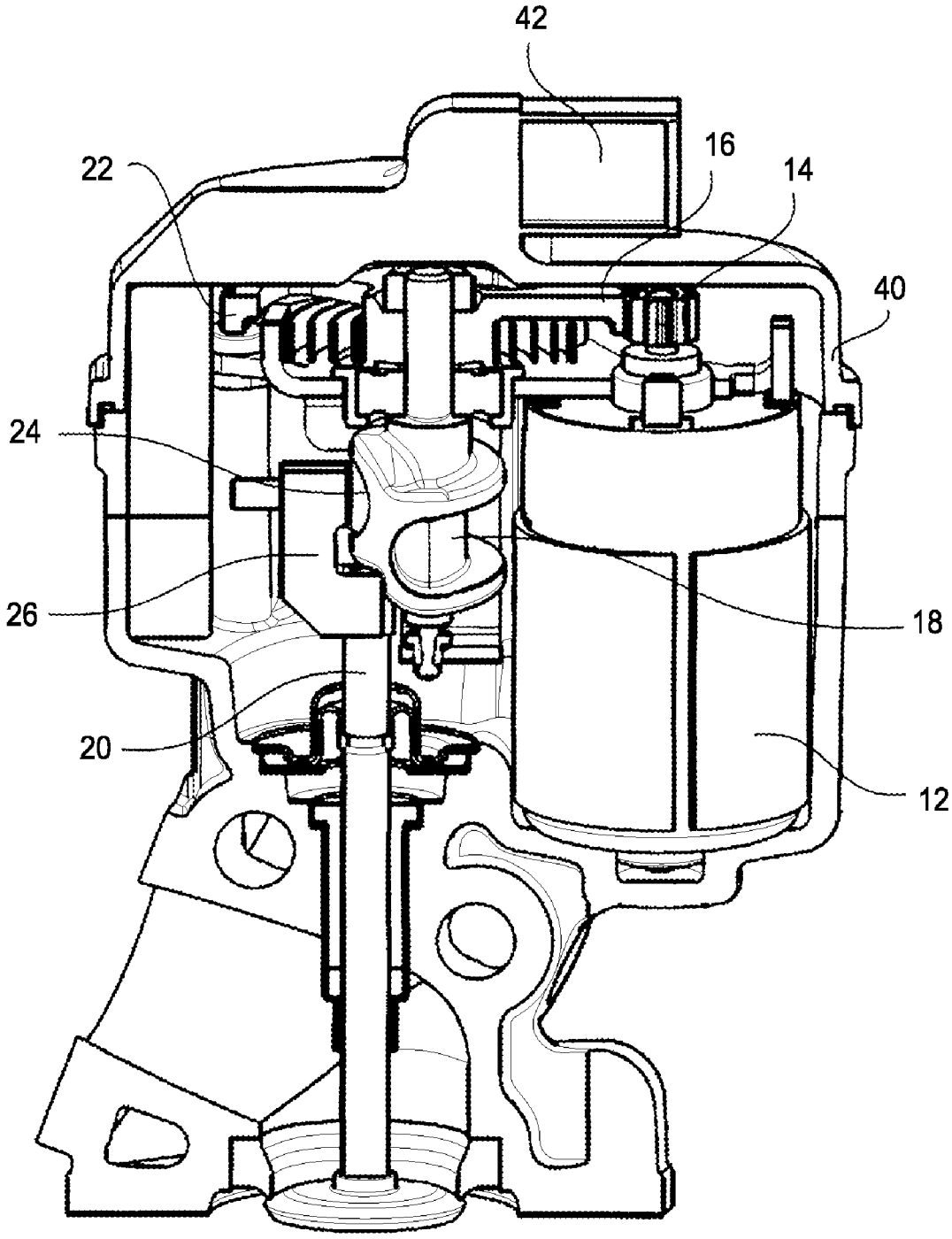
FIG. 2 shows a partially cut-away view of the exhaust gas recirculation valve according to the invention.

The preferred embodiment illustrated in the figures provides a further advantage, which will be explained by means of FIG. 2. To begin with, in FIG. 2 the gear 16 and the coil spring 22 are shown in section for better understanding. From FIG. 2 one may further take that the worm 18 comprises a nearly complete turn of a thread. Further, from the illustration of FIG. 2 one may take the additional advantage that the location at which the small wheel 24 engages the thread of the worm 18 is largely aligned with the axis of the valve tappet 20. In this way, no transverse or lateral forces are generated, offering advantages for the durability of the valve. As mentioned, this arrangement is achieved by means of the largely U-shaped bracket attached at the upper end of the valve tappet 20 and rotatably supporting the small wheel 24 at its other end.

As can additionally be taken from FIG. 1, a stationary guide 38 may be provided, which comprises a protrusion (not discernable in FIG. 1) extending into a slit of the bracket 26, for example, so that the bracket 26, which translates together with the valve tappet 20 upon actuating the valve, is guided in the direction of motion. FIG. 1 also shows that the guide 38 may be arranged on a plate 44 to which the drive 12 may additionally be attached and/or in which the axis of the worm 18 may be supported.

What is claimed is:

1. An exhaust gas recirculation valve, comprising:

a drive;

at least one rotatable drive element that is rotated by the drive; and at least one translationally drivable driven element that is translated by the drive element;

wherein the drive element comprises a worm gear defining a thread element, and wherein a rotational axis of the worm gear is inclined at a non-orthogonal angle with respect to a translational axis of the driven element.

2. The exhaust gas recirculation valve of claim 1, wherein the drive element has a surface with which at least a portion of the driven element is in contact and which is largely perpendicular to the translational axis of the driven element.

3. The exhaust gas recirculation valve of claim 1, wherein a location at which at least a portion of the driven element is in contact with the drive element is at least largely aligned with a translational axis of a translationally moved valve element.

4. The exhaust gas recirculation valve of claim 1, wherein a valve element movable by the driven element is moved only translationally and is not twisted.

5. The exhaust gas recirculation valve of claim 1, wherein an opening direction of a valve element runs against the exhaust gas pressure.

6. The exhaust gas recirculation valve of claim 1, wherein the drive rotates the drive element through a single-stage transmission.

7. The exhaust gas recirculation valve of claim 1, wherein the drive element is connected to a spring element which is solely twisted upon actuating the valve.

8. The exhaust gas recirculation valve of claim 1, comprising an integral valve housing that supports at least the drive element.

9. The exhaust gas recirculation valve of claim 8, wherein the valve housing has at least one cooling channel.

10. An exhaust gas recirculation valve, comprising:

a drive motor;

at least one rotatable drive element that is rotated by the drive motor, the drive element comprising a worm gear defining a thread portion; and at least one translationally drivable driven element that is contacted by the thread portion and translated in response to rotation of the drive element, wherein the driven element selectively opens a valve element;

wherein a rotational axis of the worm gear is inclined at a non-ortho orthogonal angle with respect to a translational axis of the driven element.

11. The exhaust gas recirculation valve of claim 10, wherein a surface of the thread portion of the drive element with which at least a portion of the driven element is in contact is substantially perpendicular to the translational axis of the driven element.

12. The exhaust gas recirculation valve of claim 10, wherein a location at which at least a portion of the driven element is in contact with the surface of the thread portion of the drive element is at least substantially aligned with the translational axis of the driven element and valve element.

13. The exhaust gas recirculation valve of claim 10, wherein the valve element is moved only translationally and is not twisted.

14. The exhaust gas recirculation valve of claim 10, wherein an opening direction of a valve element is against the exhaust gas pressure.

15. The exhaust gas recirculation valve of claim 10, wherein the drive motor rotates the drive element through a single-stage transmission.

16. An exhaust gas recirculation valve, comprising:

a drive motor;

at least one rotatable drive element that is rotated by the drive motor, the drive element comprising a thread portion; and at least one translationally drivable driven element that is contacted by the thread portion and translated in response to rotation of the drive element, wherein the driven element selectively opens a valve element;

wherein a rotational axis of the drive element is inclined with respect to a translational axis of the driven element, wherein the drive element is connected to a torsion spring element which is twisted upon opening of the valve element and develops a force tending to close the valve element.

17. The exhaust gas recirculation valve of claim 10, comprising an integral valve housing that supports at least the drive element.

18. The exhaust gas recirculation valve of claim 17, wherein the valve housing has at least one cooling channel.

19. The exhaust gas recirculation valve of claim 10, wherein the worm gear is supported at its upper and lower ends.

20. The exhaust gas recirculation valve of claim 10, wherein the driven element comprises a U-shaped bracket that is attached to the upper end of the driven element and carries a wheel that engages the thread portion of the worm gear.

21. The exhaust gas recirculation valve of claim 10, further comprising a transmission, wherein the drive motor and the worm gear are both located on the same side of the transmission.

22. The exhaust gas recirculation valve of claim 21, the drive motor further comprising a rotational axis of a motor output shaft, wherein the rotational axis of the motor output shaft is offset from and parallel to the rotational axis of the worm gear.

* * * * *